United States Patent [19]

Edwards

[11] Patent Number: 4,782,970

[45] Date of Patent: Nov. 8, 1988

[54] MAGNETIC TRASH CONTAINER LID

[76] Inventor: Richard E. Edwards, 100 Loma, Apt. 403, Long Beach, Calif. 90803

[21] Appl. No.: 50,773

[22] Filed: May 18, 1987

[51] Int. Cl.[4] ..... B03C 1/26

[52] U.S. Cl. ..... 220/1 R; 220/90; 209/223.1

[58] Field of Search ..... 220/1 R, 1 T, 85 F, 220/90; 209/214, 223.1, 223.2

[56] References Cited

U.S. PATENT DOCUMENTS

| | | | |
|---|---|---|---|
| 1,138,889 | 5/1915 | Rand | 209/223.1 X |
| 1,930,108 | 10/1933 | Reeder | 209/223.1 X |
| 2,698,450 | 1/1955 | Mack | 220/90 X |
| 4,203,537 | 5/1980 | McAlister | 220/90 X |
| 4,279,744 | 7/1981 | Antonwitsch | 209/214 |
| 4,367,138 | 1/1983 | Kustas | 209/224 |
| 4,494,657 | 1/1985 | Oldenkamp | 209/636 |
| 4,706,818 | 11/1987 | Zutell et al. | 209/223.1 X |

OTHER PUBLICATIONS

Katchall Industries Brochure.
Dripcut Corporation Brochure.

*Primary Examiner*—Steven M. Pollard
*Attorney, Agent, or Firm*—Stetina and Brunda

[57] ABSTRACT

A lid fits to the top of a standard 32 gallon garbage container to magnetically intercept tableware out of food trash being entered into the container. The lid presents a "U"-shaped channel or chute, extending toward an aperture sized to permit the food trash to enter into the trash container. Magnets are mounted on the interior of an opposite pair of sidewalls of the aperture to be isolated from direct contact with the food trash. Food trash is deposited upon the chute and then scraped toward the aperture with minimum vertical velocity. While free-falling through the aperture, tableware is attracted and segregated out of food trash and held flat to one of the two opposed sidewalls mounting the magnets.

6 Claims, 2 Drawing Sheets

MAGNETIC TRASH CONTAINER LID

DESCRIPTION OF THE RELEVANT ART

1. Field of the Invention

The present invention relates to magnetic lids for reservoirs, particularly trash reservoirs, which lids separate magnetically attractable items, particularly metal tableware, from non-magnetic material, particularly food trash. The lids prevent inadvertent entry of magnetically attractable items into the reservoir, particularly preventing inadvertent discard of metal tableware during disposal of food trash.

2. Description of the Relevant Art

During disposal of food trash into trash receptacles, primarily as performed in the restaurant and food service industry, it is possible that tableware comingled with food trash may become inadvertently entered into the trash container and discarded as trash. As is well known, pieces of ferrous metal tableware such as knives, forks, and spoons are typically costly. As such, any significant loss of this tableware during the disposal of food trash presents an added cost to food service operations. Compounding the problem of inadvertent losses resulting from busing activities conducted by food service personnel who are attentive to prevent loss, food trash is often disposed of by personnel who may be hurried and/or careless in their job performance whereby tableware items may be irretrievably lost during the disposal of food trash.

In order to deal with the problem of preventing inadvertent discard of tableware comingled with food trash, several devices exist in the prior art. These devices are configured as lids which variously fit unto standard food trash receptacles (normally made of plastic), or to the tops of busing tables upon which food trash is dumped and then entered into diverse under-table containers. Such prior art tableware retriever devices employ magnets, normally permanent magnets. In one variant of these devices, the upper surface of the device defines a hole to the container reservoir through which food trash is entered into the reservoir. This upper surface typically comprises the rim of a lid which fits upon the container, or the flat surface of a busing table. Either upon or below the upper surface, and circumferentially around the normally-circular hole, one or more magnets are affixed. The magnets are designed to attract and seperate ferrous metal tableware from food trash, thereby preventing its passage through the hole along with the food trash into the trash reservoir.

Unfortunately, when food trash and comingled tableware is scrapped or deposited directly into the hole of the reservoir—which hole must be of certain minimum size in order to permit the efficient and effective entrance of such food trash—the tableware is often times not reliably intercepted. This is caused by the permanent magnets of the prior art being generally (i) insufficiently strong, (ii) insufficiently positioned, and/or (iii) insufficiently designed so as to effectively prevent such tableware from passing through the magnetic field of the hole and into the trash reservoir. In particular, a circular hole to a trash reservoir which hole is circumferentially ringed with permanent magnets is only of very limited effectiveness in preventing magnetically attractable tableware from entering into the trash reservoir.

In recognition of these insufficiencies of performance, one prior art magnetic trash container lid mounts strong magnets in a linear array across the face of the entrance hole to the food trash reservoir. Unfortunately, while this apparatus is of improved effectiveness to intercept tableware, the obstruction presented by the array within the entrance hole impedes entrance of food trash into the trash reservoir. Additionally, the arrayed magnets are fully exposed to trash and, being so exposed, become an immense structure upon which trash is retained and bacterial growth is supported. In summary, the prior art magnetic trash container lids which present a hole which is so constricted and/or obstructed with magnets so as to be of any reasonable effectiveness in preventing the inadvertent entry of tableware into a food trash reservoir have also proven to impede the effective entrance of food trash into the reservoir.

SUMMARY OF THE INVENTION

The present invention is embodied in an improved magnetic lid to a container, normally a trash container. The lid fits upon and defines an entrance hole or aperture to the reservoir of the container which significantly prevents magnetically attractable articles from passing through the hole and into the reservoir. Particularly, the apparatus of the present invention serves to magnetically attract knives, forks, spoons and other ferrous metal tableware from dish scrappings, pot scrappings, and general food trash with which such tableware is comingled. By such attraction the apparatus segregates valued tableware from trash and prevents inadvertent loss of tableware during the disposal of food refuse.

In its function, the magnetic trash container lid apparatus of the present invention implements four separate and independent principles in order that optimal interception of magnetically attractable tableware from food trash being entered into a trash reservoir may be obtained. The first principle is that the tableware comingled with food trash should not pass too quickly and with too high a vertical velocity through a magnetic field existing about the aperture of the reservoir. Unless the velocity is low, no reasonable strength of the magnetic field will suffice to properly intercept the tableware by magnetical attraction. The second principle is that the magnetic field, or region, by and within which tableware is magnetically segregated from food trash should preferably extend as long as possible within that spatial region whereat both the food trash and tableware are in a free fall condition, and are thus free to seperate. The third and fourth principles relate to the geometry of both (i) the trash aperture and (ii) the magnetic field existing about the aperture. Both are specifically chosen such that tableware items magnetically attracted out of food trash will become held flat against a planar wall of the aperture which is sized to substantially receive the entire length of tableware the item thereon. Each of these principles may be seperately and severably implemented, but their combined implementation in the apparatus of the present invention is particularly synergistic.

In order to implement the first principle of the present invention, the lid apparatus in accordance with the present invention incorporates an upper surface geometry which reduces the vertical velocity of metal tableware (and of the food trash within which such tableware is contained) essentially to zero at that point whereat such tableware falls through the trash aperture toward the trash reservoir. In structure, this upper surface geometry of the lid particularly defines a "U"-shaped channel, or chute, which preferably has a planar base and includes an opening or hole through which trash may pass and enter into the trash reservoir. This planar base is preferably as wide, or wider than, the longest dimension of a hole into the trash reservoir which is further defined by the lid at one end terminus to the "U" channel. The "U"-shaped channel linearly extends between the aperture and an operator who is busing food trash, and preferably slopes gently downward toward the aperture in order that liquids will run into the hole.

In order to implement the second principle of the present invention, the trash aperture in the lid apparatus through which trash and comingled metal tableware is entered into the trash reservoir is surrounded by elongate downwardly extending planar sidewalls. Strong magnets disposed behind these sidewalls have a significant spatial length of magnetic interaction and thereby a sufficient time duration in which to magnetically attract tableware from the trash (which trash and tableware are preferably falling through the hole with reduced vertical velocity in accordance with the first principle).

In order to implement third and fourth principles of the present invention, (i) the trash aperture through which food trash passes is formed as a parallelogram, preferably a rectangle, in cross section, and (ii) the magnets are mounted only upon opposing sides of the aperture. The aperture thus presents flat, as opposed to curved, planar side surfaces against which substantially linear tableware items may be held thereagainst by magnetic attraction. Moreover, the oppositely mounted magnets promote each tableware item to be flatly held to one side wall only of the aperture, and not be held in a position bridging two adjacent sides thereto. The magnets are preferably mounted on the interior to the hole sidewalls, and are preferably mounted upon the particular two opposing sidewalls which are perpendicular to the axis of any "U"-shaped channel, or chute. The interior mounting of the magnets allows the entire lid to be of unitary construction which encapsulates the magnets therein, thereby presenting smooth and nonpourous working surfaces which do not accumulate contamination, and which are readily cleaned.

By the combination of (i) reduced vertical velocity of food trash and commingled tableware through the aperture, (ii) a long spatial region of magnetic interaction, (iii) flat side, or sidewall, surfaces against which the tableware may be held and (iv) plural magnets mounted upon opposed sides, or sidewalls, of a preferably rectangular cross-section aperture, the preferred apparatus of the present invention serves to optimally and effectively intercept tableware from food trash.

In operation for retrieving tableware from food trash, the magnetic trash container lid apparatus of the present invention initially receives food trash which is deposited by the operator substantially on the planar base of the "U"-shaped channel, or chute. When resting on this planar base the food trash has a zero vertical velocity. The operator next pushes the trash horizontally down the gentle slope of the chute toward the central trash aperture. The trash thereby assumes only a very small, almost zero, vertical velocity. When the trash finally reaches the aperture, much of it impinges against the flat sidewall of the rectangular cross-section aperture which is oppositely disposed across the length of the channel from the operator. The metal objects within such trash are magnetically attracted by magnets mounted behind this sidewall and behind the opposing sidewall of the aperture. These metal objects are held flat against the flat sidewalls whereat they may be readily visually observed and retrieved by the operator.

DESCRIPTION OF THE DRAWINGS

These as well as other features of the present invention will become more apparent upon reference to the drawings wherein.

DESCRIPTION OF THE PREFERRED EMBODIMENT

Figure 1:
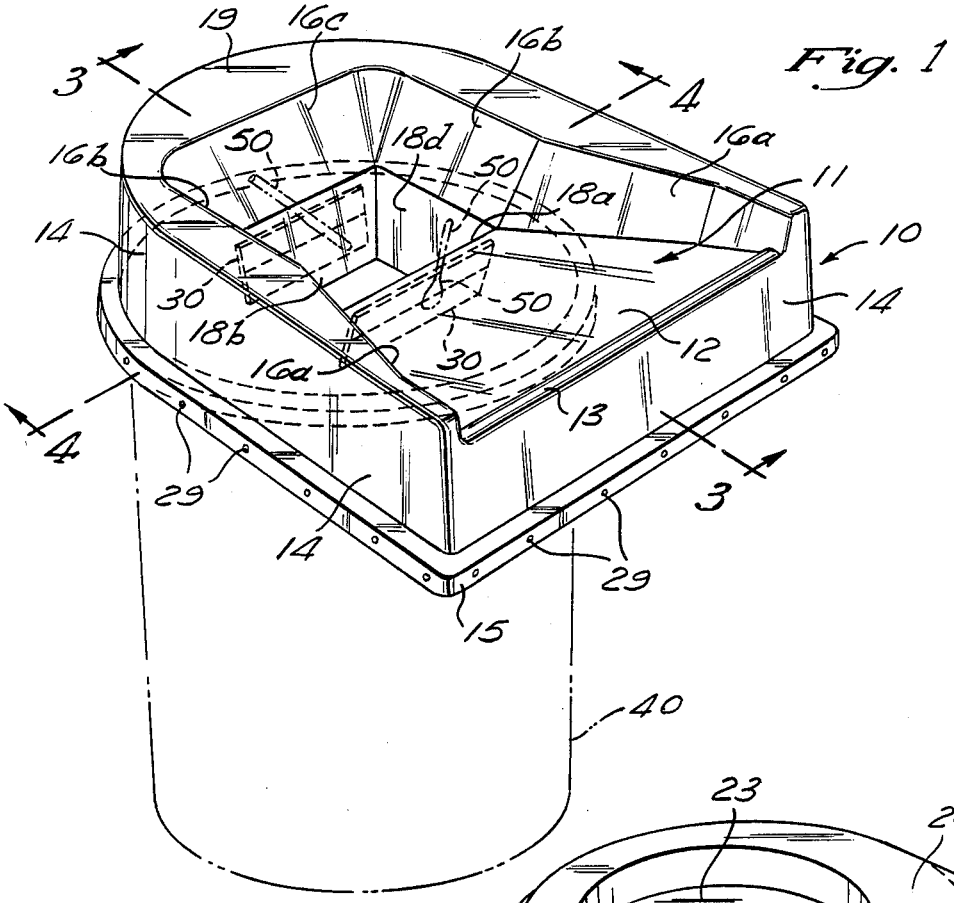
FIG. 1 is a perspective view of the Magnetic Trash Container Lid of the present invention disposed upon a trash container.

The present invention concerns the magnetic attraction and segregation of magnetically attractable metal, nominally knives, forks, spoons, and other tableware articles, from other materials, nominally from dish scrappings, pot scrappings and general food trash, within which such metal and/or metal items may become comingled. The purpose, and goal, of such magnetic attraction is the total prevention of inadvertent tableware entrance into a reservoir. It is an additional purpose of the present invention that an apparatus particularly for magnetically attracting metal tableware from food trash should be readily adaptable to standard sized garbage containers, and that the apparatus should be both sanitary and easily cleanable.

The present invention is embodied in one variant as a trash container lid for magnetically attracting metal tableware and other metal items out of food trash. A preferred embodiment of the invention which embodiment is particularly configured to fit without adjustment onto the top of any standard 32 gallon garbage container is shown in FIGS. 1–5. As may be appreciated from the perspective views of FIG. 1 and FIG. 2, the external configuration of the embodiment is defined by a housing formed from an upper member 10 and lower member 20, both normally fabricated or formed from high density plastic. The apparatus mounts to a standard 32 gallon garbage container 40 (illustrated in phantom line) by engagement of such container 40 with lower member 20. The apparatus has approximate dimensions of 24"×21"×8". The lower member 20 is formed having an annular rim 21 having an inside radius of approximately 10" which extends over the upper edge of the container 40. Located within, and extending through both members 10 and 20 is a central hole or aperture 17 of approximately 8.0"×4.75" dimensions through which food trash and the like may pass into the container 40.

In the preferred embodiment of the apparatus of the present invention shown in FIG. 1, the upper member 10 is formed having a top surface 19, outside walls 14 and peripheral lip 15. It defines a generally "U"-channel chute 11 which has a wide planar horizontal base 12 which slopes downward toward the aperture 17. At the distal edge of the planar base 12 (i.e. the edge which is disposed toward an operator-user of the apparatus) is a raised shoulder or lip 13. The chute 11 narrows in width as it extends toward the aperture 17 as defined by chute sidewalls 16*a*, and terminates at an end wall 15.

Figure 2:
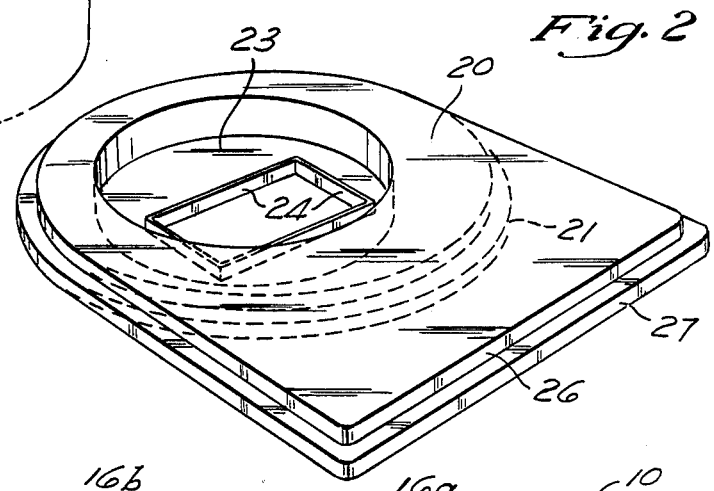
FIG. 2 is a perspective view of lower housing member of the present invention.
Figure 4:
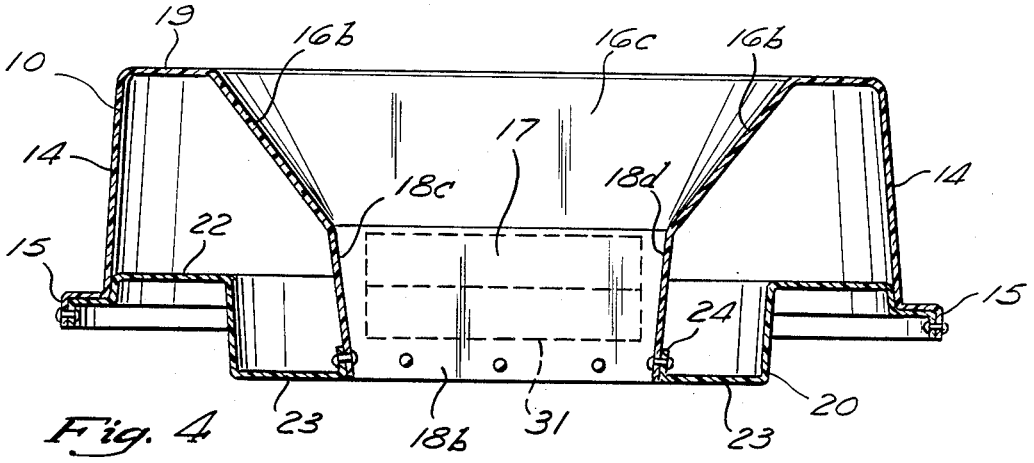
FIG. 4 is a cross-sectional view taken along Lines 4—4 of FIG. 1.
Figure 5:
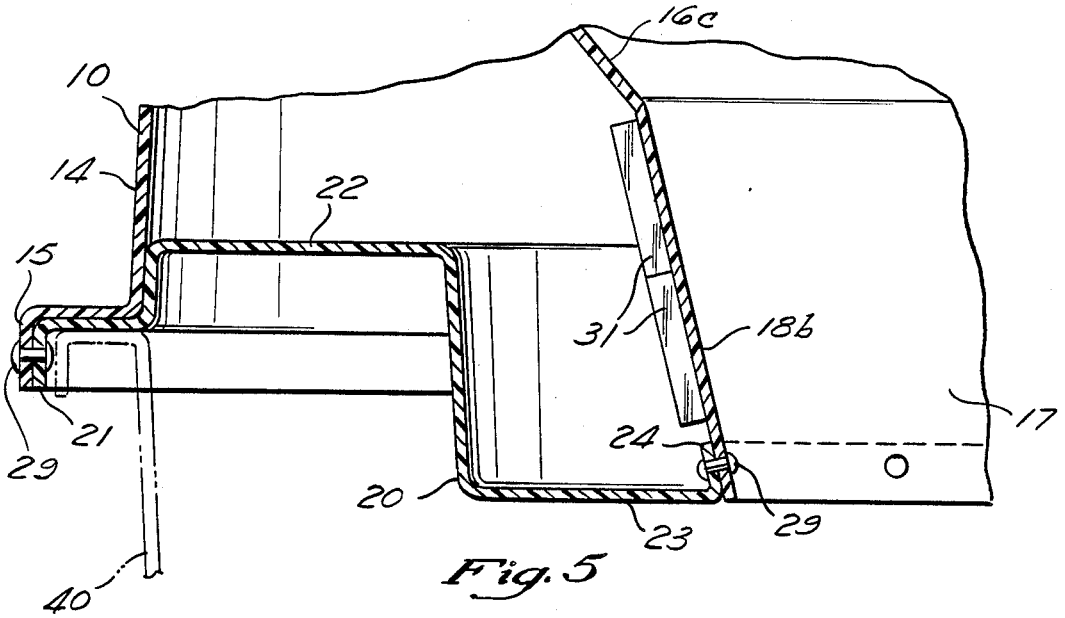
FIG. 5 is a partial cross-sectional view depicting the position of the magnets encased within the magnetic trash can lid of lid of the present invention.

As may be best observed in FIGS. 1, 2, and 4 the chute sidewalls 16*b* and end wall 16*c* extend angularly downwardly into the aperture defined by aperture sidewalls 18*a, b, c,* and *d*. These aperture sidewalls 18*a–d* preferably extend downwardly through a distance at least one-half the width of the lower opening of aperture 17. Since this dimension of the aperture is preferably approximately 8.0", the sidewalls 18 are preferably at least 4" deep in length. Plural magnets 30 are mounted to the interior sides of the sidewalls 18*a–d* in a manner which will be discussed.

The cross-section configuration of the aperture 17 is preferably formed as a quadrilateral, particularly as a parllelogram, and more particularly as a rectangle. The overall three-dimensional shape of the aperture is that of a truncated pyramid.

The lower housing member 20 may be observed in a perspective view in FIG. 2 depicted in its relative assembled orientation to the upper member 10. As previously described, the lower member 20 is provided with an annular rim 21 which is sized to mate with the top edge of a standard size trash reservoir 40 and thereby form a support mechanism for the lid 10. The rim 21 extends via a recessed surface 22 to a cylindrical bottom wall portion 23 which presents an annular downwardly extending ring about the aperture 17.

The outer periphery of the member 20 includes an outer lip or flange 27 and an inner lip or flange 26 which mate with the interior perimeter surface of the upper housing memeber 10. Further, a rectangular flange 24 is provided which is sized to extend about the central trash aperture 17 and mate with the aperture sidewalls 18*a–d*. When assembled as an integral part of the apparatus of the present invention, the lower member 20, which has been shown in isolation for purposes of explanation in FIG. 2, mounts to upper member 10 along the entirety of flanges 26 and 27 and along the flanges 24 either by adhesive or thermoplastic sealing, or, preferably, by rivet fasteners which extend through both members 10 and 20 as illustrated. The heads of rivets 29 are preferably made of polished and non-corrosive metal which is not subject to rust or to collect contamination. When the upper member 10 is affixed tightly to the lower member 20, a sealed air cavity is formed between such members which is unlikely to collect contamination or develop odors even when the magnetic trash container lid is splashed (as will inevitably occur) on its topside and underside with garbage.

Figure 3:
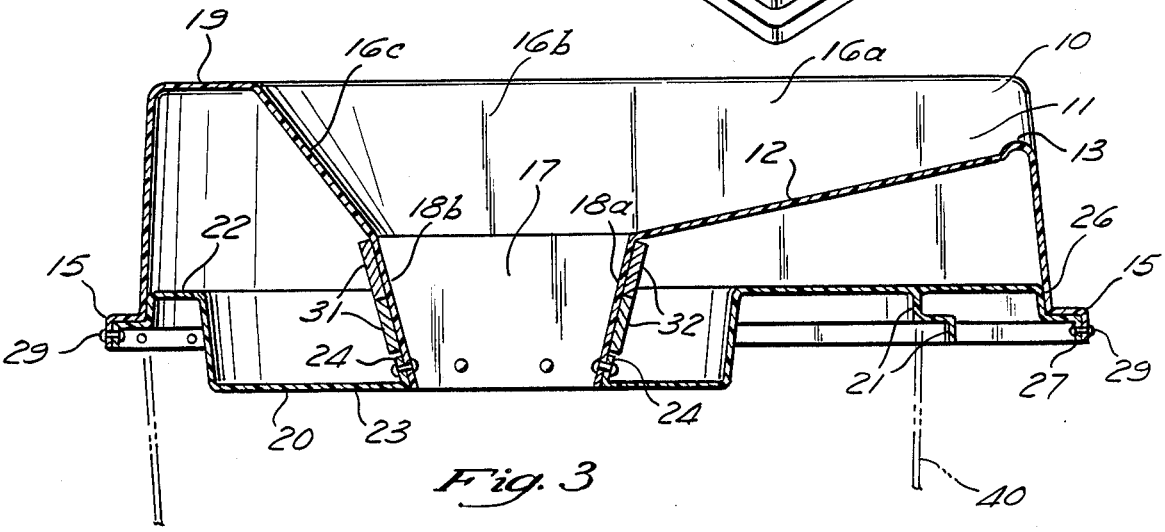
FIG. 3 is a cross-sectional view taken along Lines 3—3 of FIG. 1.

As shown in FIG. 3, plural magnets 30 are positioned on the interior of the housing member 10 and 20 adjacent the trash aperture 17. These magnets 30 consist of rearwardly-positioned magnets 31 affixed by way of adhesive to the interior side of the aperture sidewall 18*b*, and the magnets 32 affixed to the interior side of the opposite aperture sidewall 18*a*. These sidewalls 18*a,b* are substantially perpendicular yet slightly angularly inclined to the baseplane 12 of chute 11, and substantially orthogonal to the central axis of chute 11.

The magnets 31 and 32 may be mounted in pairs as bar magnets, as illustrated. Newer-type permanent magnets using rare earths in order to produce high magnetic fields may be used if desired. Generally, however, the magnets 30 are chosen to deliver maximal magnetic field strength at a minimal cost. Since weight and volume are not strong constraints in the application of the present invention, and since the weight of magnets 30 may indeed help to hold and stabilize the magnetic trash container lid on the garbage container 40, the magnets 30 are normally quite sizable and heavy.

Generally the appropriate magnetic field strength of magnets 31 and 32 is empirically established at a level so that an item of magnetically attractable tableware which is centrally dropped into hole 17 from a height equal to the upper surface 19 of the upper member 10 will never fall through the hole 17, but will always be attracted to and held upon one or the other of the sidewalls, 18 at the respective position of either the magnets 31 or 32. Magnets sufficiently strong to accomplish this attraction may be of the iron or alnico types, and are conventional in the art. Each of the magnets 31 and 32 is preferably comprised of two parallel bar magnets type ceramic five made of ceramic and available from crucible magnets, each approximately 1" l.×4" w.×3" d.

It should be noted before leaving discussion of magnets 30 that a metal item which is intentionally thrown centrally into hole 17 with a high vertical velocity may be able to escape through the magnetic trash container lid of the present invention and enter into the garbage pail 40 regardless of any reasonable strength which is established for magnets 31 and 32. This is because the path of a metal object entering aperture 17 obviously has to be deflected sufficiently during the short time duration and small distances over which magnets 30 strongly act upon such metal object so that the metal object will come to lodge against sidewalls 18 at the positions of either magnets 31 or 32. If the metal object 50 has a sufficiently high vertical velocity, then both the time during which the magnets 30 may act and the cumulative amount of deflection occuring during such time is insufficient to capture the metal item upon the sidewalls.

It should be noted that preferably no magnets are mounted behind the opposing sidewalls 18*c,d* which are substantially parallel to the central axis of chute 11. This is for two reasons. Firstly, although magnets mounted behind sidewalls 18*c,d* would undoubtedly catch some tableware 50, they are not required for adequate function and performance of the apparatus of the present invention which preferably uses only two sets of magnets 31 and 32. Secondly, if a tableware piece 50 is simultaneously attracted to two adjacent interior sidewalls 18, for example sidewalls 18*b* and 18*c*, then it is possible that the tableware piece 50 will bridge both sidewalls, and will lie parallel upon neither. When the tableware 50 assumes such a bridging position, then the magnets may offer insufficient retentive force to capture the tableware piece 50 or, alternatively, the tableware will obstruct the aperture 17. Consequently, the placement in opposed positions of magnets 31 and 32, and the magnetic field resultant from such opposed positions, within the magnetic trash container lid of the present invention should be understood to be intentional, and are not the result of any limitations as to howsoever magnets 30 could be mounted on any of the sidewalls 18.

Further, although the magnets 31 and 32 could be affixed to sidewalls 18*a* and 18*b* by riveting, which was the preferred method for attachment of upper member 10 to lower member 12, it is preferred that such magnets should be affixed by gluing. This prevents any portion of rivets, or of any other fastening devices such as nuts and bolts, from appearing upon the interior faces of sidewalls 18*a* and 18*b* at the location whereat tableware piece 50 will be held to this sidewalls 18*a* and 18*b* by magnetic attraction. The lack of such proturberances, or obstructions, again helps that the tableware piece 50 should be firmly and reliably held to the surface of sidewall 18*b* by action of magnets 31 until, and unless, forcibly removed by a human operator.

In accordance with the preceding discussion, the present invention will be seen to embody diverse principles which are collectively cooperatively interoperative to best accomplish the desired function of the invention for separating magnetically attractable items, normally tableware, which is interspersed within other material, normally food trash. In implementation of a first principle, the linear extent of chute 11, and the distance of aperture 17 from the position of the operator busing food trash first onto the magnetic trash container lid of the present invention and then into the container 40, deters an operator from throwing such trash with high velocity directly through hole 17 into container 40. In this regard, the operator is encouraged by design of the chute 11 to initially deposit all food trash upon the chute 11. This depositing eliminates the vertical fall which the trash has undergone during being bussed from dishes and the like, and reduces the vertical velocity of such trash to zero. The operator then may horizontally scrape the food trash from its temporary position within and upon chute 11 toward the aperture 17. During such scraping the food trash will assume only a very small, essentially zero, vertical velocity resultant from its progress down the gentle slope of chute 11. When such trash finally enters or is disposed above aperture 17, it will then be moving (i) at an essentially zero vertical velocity, and (ii) in a lateral or horizontal direction along chute 11. These movements combinatorially maximize the probability that any tableware within such trash will be strongly affected by magnets 31 and 32. The strong effect of magnets 30 is more than sufficient to ensure that tableware pieces 50 will be reliably recovered from food trash during normal, correct, use of the magnetic trash container lid apparatus of the present invention.

In implementation of the second through fourth principles of the present invention, the nature of aperture 17 and its sidewalls 18, and the extent and placement of magnets 31 and 32, should be understood not to be arbitary, but rather to be well considered in accordance with the desired operation of the apparatus. First, the magnets are mounted upon, and acting through, the sidewalls 18 which are high, or long, relative to the longest dimensions to the opening of aperture 17. This relationship means that the magnets have a long residence period of time in which to influence magnetically attractable objects falling through the hole 17. Further, the magnets creating the magnetic field within the aperture 17 are particularly disposed on opposite sidewalls 18*a* and 18*b* of the aperture 17. This opposite positioning, especially as compared to an alternative complete circumferential disposition around a hole which is either circular or square in cross section, optimally serves to make tableware 50 reliably attracted and held flat upon at least one of two opposed sidewalls 18*a,b*, and that the magnets 30 will not interact to defeat the desired function. Further, it will be noted that due to the food trash being transported horizontally along the length of the chute 11, the comingled food trash and tableware is in effect thrown directly against the chute backwall 16 and/or aperture sidewall 18*b* such that the tableware so directly contacts that portion of the device housing the magnets 31 or is thrown backward toward the magnets 32.

Finally, it should be noted that all components of the preferred embodiment apparatus are of a sanitary nature typically will all exterior surfaces be molded of polypropylene with no joints, recesses, or any other features existing which would collect contamination and/or accumulate waste and odors. Particularly, the magnets 30 are encased within the sealed internal cavity of the magnetic trash container lid apparatus. The entire apparatus is durable. It is readily transferable from one garbage container to another and its service life time is uneffected by the amount of magnetically attractable items which are intercepted.

It should be understood that each principle of the present invention can be independently and severally implemented to beneficial effect. The chute is operative to reduce the vertical velocity of food trash even when such trash might later be scraped into a circular, shallow, circumferentially-magnetically-rimmed hole which is in all respects quite conventional. Even if no chute is employed, a hole having deep sidewalls which are lined with magnets is a superior configuration to a shallow-rimmed hole. Even if no chute is employed, and even if the aperture does not have deep sidewalls, it is superior that the aperture should be rectangular, and not round or square in shape. It is superior that any polygonal or quadrilateral cross-sectional shaped aperture should employ magnets only upon substantially opposing sides. When these principles become recognized, then they are obviously susceptible of combination in diverse manners. Further, it will be recognized that although the apparatus is specifically designed to fit upon a standard sized 32 gallon reservoir, the device may also be modified, particularly by construction of the annular rim 21, to accomodate differing sized containers. In addition, the device may be mounted in a table top application.

Therefore in accordance with the preceding explanation, the present invention should be broadly conceived to be a multi-faceted system for the interception of magnetically attractable metal items from out of other material being entered into a reservoir, particularly for interception of tableware interspersed in food trash entered into a trash reservoir. The system is replete in many cooperatively interoperative elements. Correspondently, the following claims should be interpreted in accordance with their express language, only, and not solely in accordance with the particular preferred embodiment implementation in reference to which the principles of the present invention have been taught.

What is claimed is:

1. A device for separating magnetically attractable items from food waste material prior to entry of said food waste material into a waste container comprising:

a housing adapted to be supported adjacent the entrance of a waste container;

a generally U-shaped channel formed on the upper surface of said housing comprising a first surface portion having a generally horizontal orientation formed to receive the food waste material thereon and a second surface portion having an orientation generally perpendicular to said first surface portion to define an impact surface for food waste material being manually slid upon said first surface portion toward said second surface portion;

an aperture formed in said housing between said first and second surface portions having plural sidewalls defining an unobstructed vertical entry for the food waste material into the waste container; and magnet means disposed on one side of selected ones of said plural sidewalls to be physically isolated from contact with the food waste material traveling through said aperture yet exert a magnetic force adjacent said aperture sufficient to magnetically hold magnetically attractable items contained in the food waste material upon said selected ones of said plural sidewalls.

2. The device of claim 1 wherein said housing is formed of an upper housing portion and a lower housing portion which portions encase said magnet means within the interior of said housing.

3. The device of claim 2 wherein said lower housing portion includes means for registering said housing upon the entrance of the waste container.

4. The device according to claim 1 wherein said aperture is formed in a parallelogram configuration.

5. The device according to claim 4 wherein said aperture has a parallelogram cross section configuration and said magnet means are mounted only to opposte ones of said plural sidewalls.

6. The device according to claim 5 wherein the plural sidewalls are formed in a planar configuration.

* * * * *